US012291928B2

(12) United States Patent
Owoeye et al.

(10) Patent No.: US 12,291,928 B2
(45) Date of Patent: May 6, 2025

(54) THREADED AND COUPLED CONNECTION

(71) Applicant: Saudi Arabian Oil Company, Dhahran (SA)

(72) Inventors: Oladele Owoeye, Dhahran (SA); Jasem Moyaibed, Tarut (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/076,205

(22) Filed: Dec. 6, 2022

(65) Prior Publication Data

US 2024/0183228 A1 Jun. 6, 2024

(51) Int. Cl.
*F16L 15/00* (2006.01)
*E21B 17/042* (2006.01)

(52) U.S. Cl.
CPC ..... *E21B 17/0423* (2013.01)

(58) Field of Classification Search
CPC ..... F16L 15/007; F16L 15/008; F16L 15/04; F16L 15/002; F16L 15/003; F16L 15/06; F16L 15/001; F16L 15/006; F16L 15/009; F16L 15/004; F16L 25/12; F16L 21/00; F16L 21/002; E21B 17/0423
See application file for complete search history.

(56) References Cited

U.S. PATENT DOCUMENTS 2,772,102 A 11/1956 Webb
2,992,019 A * 7/1961 Macarthur ..... E21B 17/0423 285/334.4
3,109,672 A 11/1963 Franz
3,467,413 A 9/1969 Madrelle
4,384,737 A 5/1983 Reusser
(Continued)

FOREIGN PATENT DOCUMENTS

CN 201121782 9/2008
EP 1101057 10/2006
(Continued)

OTHER PUBLICATIONS

Dong et al., "Design and Mechanical Behavior Study of Ultrahigh-Torque Variable Pitch Casing Joint," Advances in Mechanical Engineering, Jan. 2019, 11(1):1-12.
(Continued)

*Primary Examiner* — Aaron M Dunwoody
(74) *Attorney, Agent, or Firm* — Fish & Richardson P.C.

(57) ABSTRACT

A pipe assembly includes a first pipe, a second pipe, and a collar. The first pipe has a first external thread and a first annular lip that has a first external seal surface and a first internal annular beveled surface. The second pipe has a second external thread and a second annular lip with a second external seal surface and a second internal annular beveled surface. The collar is threadedly coupled to the first pipe and the second pipe to form a coupling connection. The collar has a first internal thread threadedly coupled to the first external thread and a second internal thread threadedly coupled to the second internal thread. The collar has a bore that contacts the first external seal surface and the second external seal surface to form a metal-to-metal seal that is energized under fluid pressure at the first and second internal annular beveled surfaces.

20 Claims, 3 Drawing Sheets

(56) References Cited

U.S. PATENT DOCUMENTS

| | | | | |
|---|---|---|---|---|
| 4,458,925 | A | 7/1984 | Raulins et al. | |
| 4,473,245 | A | 9/1984 | Raulins et al. | |
| 4,538,840 | A * | 9/1985 | DeLange | F16L 15/004 285/333 |
| 4,564,225 | A | 1/1986 | Taylor | |
| 4,598,455 | A | 7/1986 | Morris et al. | |
| 4,616,537 | A | 10/1986 | Axford et al. | |
| 4,728,129 | A | 3/1988 | Morris et al. | |
| 4,732,416 | A | 3/1988 | Dearden | |
| 4,786,090 | A | 11/1988 | Mott | |
| 4,795,200 | A | 1/1989 | Tung | |
| 4,796,923 | A | 1/1989 | Liggins | |
| 4,893,844 | A | 1/1990 | Chelette | |
| 5,040,827 | A | 8/1991 | DeLange | |
| 5,064,224 | A | 11/1991 | Tai | |
| 5,212,885 | A | 5/1993 | Buonodono et al. | |
| 5,360,239 | A | 11/1994 | Klementich | |
| 5,429,374 | A | 7/1995 | Eichenberger | |
| 5,687,999 | A | 11/1997 | Lancry et al. | |
| 6,158,785 | A | 12/2000 | Beaulier et al. | |
| 6,604,761 | B1 | 8/2003 | Debalme et al. | |
| 7,578,043 | B2 | 8/2009 | Simpson et al. | |
| 7,850,211 | B2 | 12/2010 | Reynolds, Jr. et al. | |
| 7,997,627 | B2 | 8/2011 | Sugino et al. | |
| 8,029,025 | B1 | 10/2011 | Sivley, IV et al. | |
| 8,136,846 | B2 | 3/2012 | Church | |
| 8,882,157 | B2 | 11/2014 | Chelette et al. | |
| 9,677,346 | B2 | 6/2017 | Hou et al. | |
| 10,443,318 | B2 | 10/2019 | Finke | |
| 11,053,749 | B2 * | 7/2021 | Kawai | F16L 15/002 |
| 11,353,144 | B2 * | 6/2022 | Kawai | F16L 15/007 |
| 2003/0132632 | A1 | 7/2003 | Schoonen et al. | |
| 2004/0017081 | A1 | 1/2004 | Simspon et al. | |
| 2004/0104575 | A1 | 6/2004 | Ellington et al. | |
| 2004/0174017 | A1 * | 9/2004 | Brill | F16L 15/00 285/333 |
| 2007/0063517 | A1 * | 3/2007 | Pallini, Jr. | F16L 15/004 285/390 |
| 2007/0132239 | A1 | 6/2007 | Reynolds, Jr. | |
| 2007/0164565 | A1 | 7/2007 | Evans et al. | |
| 2010/0181727 | A1 | 7/2010 | Santi et al. | |
| 2012/0032435 | A1 | 2/2012 | Carcagno | |
| 2014/0084582 | A1 | 3/2014 | Elder et al. | |
| 2015/0316181 | A1 | 11/2015 | Tejeda et al. | |
| 2016/0130885 | A1 | 5/2016 | Liu et al. | |
| 2016/0312931 | A1 | 10/2016 | Martin et al. | |
| 2017/0114942 | A1 | 4/2017 | McLaughlin | |
| 2018/0252343 | A1 | 9/2018 | Evans et al. | |
| 2018/0328119 | A1 | 11/2018 | Juarez | |
| 2019/0056049 | A1 | 2/2019 | Kawai et al. | |
| 2019/0211631 | A1 | 7/2019 | Yamaguchi | |
| 2020/0278056 | A1 | 9/2020 | Oku et al. | |
| 2020/0332930 | A1 | 10/2020 | Wajnikonis | |
| 2021/0317856 | A1 | 10/2021 | Harvey et al. | |
| 2022/0341519 | A1 | 10/2022 | Larson | |
| 2023/0072067 | A1 | 3/2023 | Wajnikonis | |
| 2023/0349241 | A1 | 11/2023 | Owoeye et al. | |
| 2023/0408000 | A1 | 12/2023 | Owoeye et al. | |
| 2024/0044426 | A1 | 2/2024 | Owoeye et al. | |

FOREIGN PATENT DOCUMENTS

| | | |
|---|---|---|
| WO | WO 1993018330 | 9/1993 |
| WO | WO 2019055295 | 3/2019 |

OTHER PUBLICATIONS

Zhang et al., "Experimental Research on Connection Performance of Variable-Pitch Threaded Casing," Advanced Materials Research, Sep. 2013, 805-806:1805-1811.

* cited by examiner

THREADED AND COUPLED CONNECTION

FIELD OF THE DISCLOSURE

This disclosure relates to tubular connections.

BACKGROUND OF THE DISCLOSURE

Wellbore strings such as production strings and drill strings direct fluid between a surface of a wellbore and a downhole location of the wellbore. During drilling, production, wellbore stimulation, or other wellbore operations, a wellbore string can leak fluid through one or more of its connections. Mechanical issues can lead to leakage of fluid out of or into the wellbore string, which can lead to damage and other problems that are costly to fix.

SUMMARY

Implementations of the present disclosure include a pipe assembly that includes a first pipe, a second pipe, and a collar. The first pipe has a first external thread and a first annular lip that resides between the first external thread and a rim of the first pipe. The first annular lip has a first external seal surface and a first internal annular beveled surface. The second pipe has a second external thread and a second annular lip that resides between the second external thread and a rim of the second pipe. The second annular lip includes a second external seal surface and a second internal annular beveled surface. The collar is disposed between and threadedly coupled to the first pipe and the second pipe to form a coupling connection. The collar has a first internal thread threadedly coupled to the first external thread and a second internal thread threadedly coupled to the second internal thread. The collar has a bore residing between the first internal thread and the second internal thread to contact, with the coupling connection formed, the first external seal surface and the second external seal surface to form a metal-to-metal seal that is energized under fluid pressure at the first and second internal annular beveled surfaces.

In some implementations, the collar further includes a third annular lip residing between the first internal thread and a first rim of the collar pipe. The third annular lip has a first internal seal surface and a first external annular beveled surface. The collar further includes a fourth annular lip residing between the second internal thread and a second rim of the collar pipe. The fourth annular lip includes a second internal seal surface and a second external annular beveled surface. The first and second internal seal surfaces contact, with the coupling connection formed, respective external walls of the first and second pipes form a metal-to-metal seal that is energized under fluid pressure at the first and second external annular beveled surfaces to prevent fluid from flowing across the coupling connection.

In some implementations, the first pipe and second pipe are disposed within a wellbore and flow production fluid or injection fluid. The first pipe and the second pipe have an external diameter of less than 7 inches.

In some implementations, the first external thread includes a first tapered thread, a second tapered thread, and a shoulder residing between the first tapered thread and the second tapered thread. The first tapered thread includes a first square thread with a first flank slanted with respect to a plane orthogonal to a longitudinal axis of the first pipe and the second tapered thread includes a second square thread with a second flank slanted with respect to the plane. The first internal thread has two corresponding tapered threads spaced by a shoulder. The two corresponding tapered threads are threadedly coupled to the first and second tapered threads.

In some implementations, the first internal thread includes a load flank and the first external thread includes a stab flank. The load flank is slanted at an angle of between negative 2° and negative 8° with respect to the plane. The stabbing flank has a positive angle of between 7° and 15° with respect to the plane.

In some implementations, the shoulder of the first external thread bears, with the coupling connection formed, against the shoulder of the first internal thread, increasing a torsional capacity of the coupling connection absent a shoulder.

In some implementations, the first tapered thread is less coarse than the second tapered thread.

In some implementations, the pipe assembly also has a sealing ring disposed at one of the shoulders to form, with the other one of the shoulders, a seal.

In some implementations, the first and second external threads include a concave root to form, with the coupling connection formed, a dope pocket defined between the concave root and a crest of the first and second internal threads. The dope pocket increases a galling resistance of the threads with respect to a threaded connection with a flat root and crest.

In some implementations, the first pipe includes an internal upset including a section converging from a first bore of the first pipe to a second bore of the first pipe. The second bore spans the length of the first threaded end and defines an internal diameter smaller than the internal diameter of the first bore.

In some implementations, the section is slanted at an angle of between 1° and 30° with respect to a longitudinal axis of the first pipe.

In some implementations, the first thread includes a crest tapered inwardly in a direction extending from a start of the thread to the rim and with respect to the longitudinal axis.

In some implementations, the collar has an annular groove between a transition between the bore and the first internal thread. The annular groove forms a dope pocket configured to retain lubricant to release stress from the first internal thread during make up.

Implementations of the present disclosure also include a method that includes connecting a first pipe to a collar. The first pipe has a first external thread and a first annular lip residing at an end of the first pipe. The collar has a first internal thread and a second internal thread with a bore residing between the first and second internal threads. Connecting the first pipe to the collar includes threadedly coupling the first external thread to the first internal thread of the collar such that a seal surface of the first annular lip contacts the bore of the collar to form a first metal-to-metal seal. The method also includes connecting a second pipe to the collar. The second pipe has a second external thread and a second annular lip that resides at an end of the second pipe. Connecting the second pipe to the collar includes threadedly coupling the second external thread to the second internal thread of the collar such that a seal surface of the second annular lip contacts the bore of the collar to form a second metal-to-metal seal. The method also includes pressurizing the first pipe and the second pipe to apply fluid pressure to the first and second annular lips. The method also includes energizing the first and second metal-to-metal seals and increasing the contact pressure of the first and second metal-to-metal seals.

In some implementations, the first pipe has an intermediate shoulder, and connecting the first pipe to the collar includes threadedly connecting the first pipe until the shoulder bears against an intermediate shoulder of the collar.

DETAILED DESCRIPTION OF THE DISCLOSURE

The present disclosure describes a pipe assembly that has a threaded and coupled type connection. Specifically, the pipe assembly has a double taper threaded and coupled connection formed with a coupling attached to an upper pipe and a lower pipe. The coupling contacts an outer surface of the pipes and the pipes contact an inner surface of the coupling to form a seal that is energized under pressure to prevent fluid from flowing across the connection. The pipe assembly also has tapered threads, dope pockets, and internal upsets to increase the reliability of the connection.

Particular implementations of the subject matter described in this specification can be implemented so as to realize one or more of the following advantages. For example, the pipe assembly of the present disclosure can increase the connection sealability during moderate to high-pressure procedures post-installation and during production, which can reduce the risk of loss of connection sealability and reduce the need to perform work over operations. Additionally, the pipe assembly can prevent horizontal scratches or dents from causing loss of connection sealability because the seal can be energized to increase the contact force of the seal. Additionally, the pipe assembly has tapered crest/root threads that can increase the galling resistance of the connection by reducing the contact force between the crest and the root of the threads during connection makeup.

Figure 1:
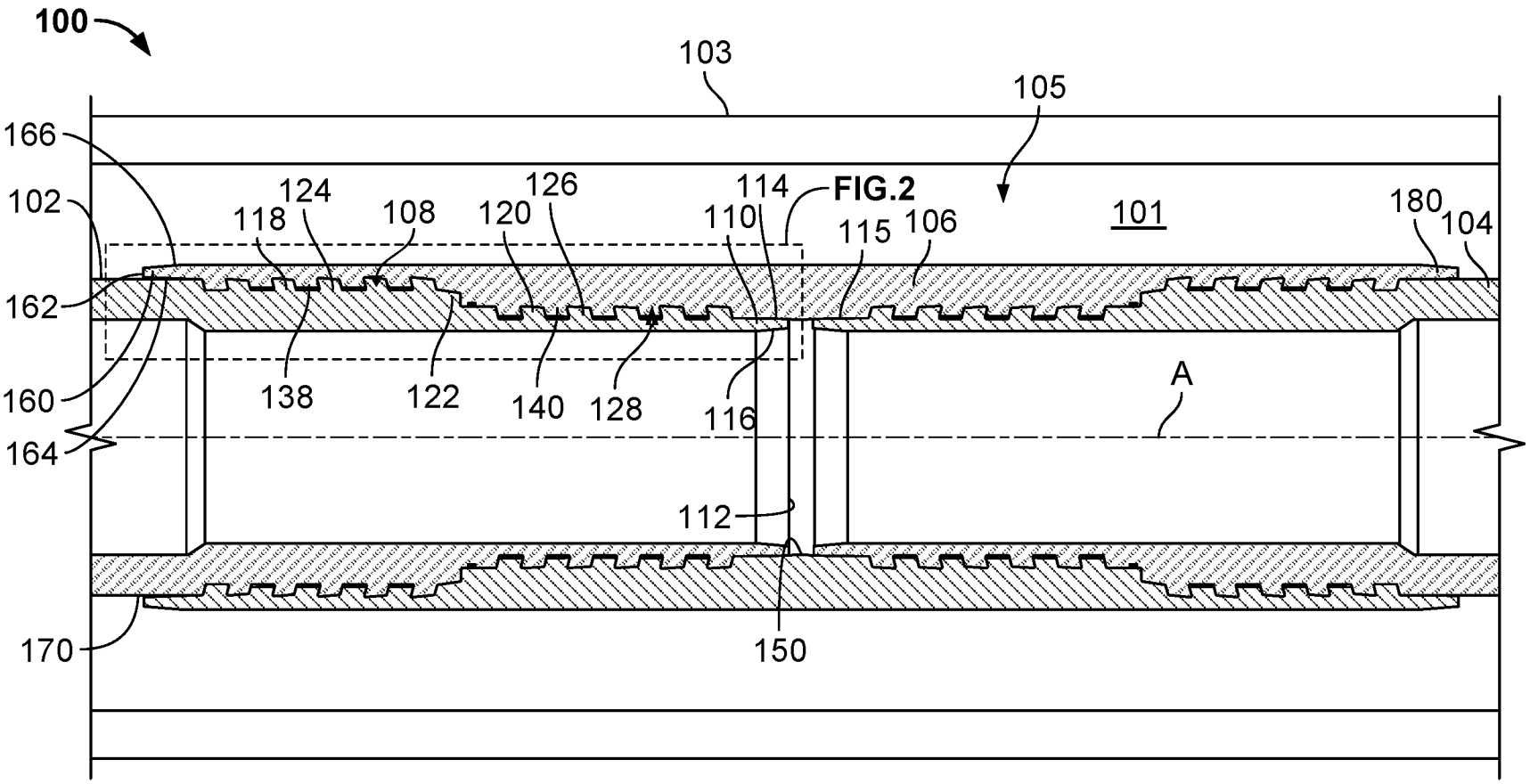
FIG. 1 is a front, cross-sectional view of a pipe assembly according to implementations of the present disclosure.

FIG. 1 shows a pipe assembly 100 (e.g., a tubular assembly or a wellbore assembly) disposed within a wellbore 103 and defining, with a wall of the wellbore 103, an annulus 101. The pipe assembly 100 has a first pipe 102, a second pipe 104, and a collar 106 (e.g., a coupling). The first pipe 102, second pipe 104, and collar 106 are threadedly attached at the surface of the wellbore 103 to form a connection 105. The first pipe 102 has a first external thread 108 and a first annular lip 110 (e.g., an annular recess) between the first external thread 108 and a rim 112 of the first pipe 102. The first annular lip 110 has a first external seal surface 114 and a first internal annular beveled surface 116 (e.g., a chamfered surface).

The first external thread 108 can be straight or tapered. For example, the first external thread 108 can have a first tapered thread 118, a second tapered thread 120, and a shoulder 121 between the first tapered thread 118 and the second tapered thread 120. As further described in detail below with respect to FIG. 3, the first tapered thread 118 and the second tapered thread 120 have a first square thread 124 and a second square thread 126, respectively. The square threads 124, 126 have a flank (e.g., a stab flank) that is slanted at a positive angle. Additionally, the first tapered thread 118 has an outer diameter that reduces from the beginning of the thread to the shoulder 121, and the second tapered thread 120 has an outer diameter that reduces from the shoulder 121 to the end of the thread (e.g., toward the rim 112). In other words, tapered threads 118, 120 can each have a different steepness. For example, the leading thread 120 (e.g., nose section) can be steeper to enhance deep stabbing and allow the stress bearing part of the connection to occur in the following thread 118 (e.g., stress-bearing section), which has a larger cross sectional area.

Furthermore, the stress-bearing thread 118 can be less coarse than the leading thread 120. This can help reduce the risk of cross threading as well as improving operational efficiency of the make-up process. In addition, the double taper profile enables deep stabbing while reducing the risk of cross-threading to as low as practicable using best practice procedure for spin-in and make up process.

The second pipe 104 is the same as the first pipe 102. For example, the second pipe has a second external thread and a second annular lip residing between the second external thread and a rim of the second pipe. The second annular lip has a second external seal surface and a second internal annular beveled surface.

When the coupling connection 105 is formed, the collar 106 resides between (and is threadedly coupled to) the two pipes 102, 104. The collar 106 has an internal thread 128 that corresponds with the external thread 108 of the first pipe 102. The internal thread 128 has a first internal thread 138 that threadedly couples to the first external tapered thread 118 and a second internal thread 140 that threadedly couples to the second external tapered thread 120.

The collar 106 also has a bore 150 that resides between the first threads of the two pipes 102, 104. The bore 150 contacts, with the coupling connection 105 formed, the first external seal surface 114 and the second external seal surface 115 of the second pipe 104 to form respective metal-to-metal seals that are energized under fluid pressure. For example, internal fluid pressure applied at the first annular beveled surface 116 and second annular beveled surface increase the contact force between the lips 110 and the bore 150 to increase the reliability of the seal and prevent fluid from flowing across the connection 105. In other words, the seal formed between the lips 110 and the bore 150 prevents fluid from flowing between the interior of the pipes and the annulus 101.

The collar pipe 106 also has an annular lip 160 that resides between the internal thread 128 of the collar 106 and a rim 162 of the collar 106. The annular lip 160 has an internal seal surface 164 and an external annular beveled surface 166. The internal seal surface 164 contacts, with the coupling connection formed, the external wall 170 or external surface of the first pipe 102 to form a metal-to-metal seal that is energized under fluid pressure at the annulus 101 to prevent fluid from flowing across the coupling connection 105. The collar 106 has an annular lip 180 on the opposite end of the collar 106. The annular lip 180 is the same as the annular lip 160 and forms a metal-to metal seal with the outer surface of the second pipe 104 that is also energized under fluid pressure at the annulus 101.

In some implementations, the pipes 102, 104 are part of a wellbore pipe (e.g., a production pipe) or completion that forms a relatively large annular clearance with the wellbore 103. For example, the pipes 102, 104 can have an external diameter that is between 2 and 7 inches (e.g., 3.5 or 4.5 inches) or larger and the wellbore can have an internal diameter larger than 8 inches (e.g., a production casing with an external diameter of 9.625 inches). Completions with a large annular clearance can lead to helical buckling during production operations with associated high dogleg severity (DLS), which can exceed the connection sealability limit. The connection 105 described herein can help the piping maintain sealability without the need of reducing the annular clearance or utilizing more robust pipes or threaded connections that have high sealability limits.

Figure 2:
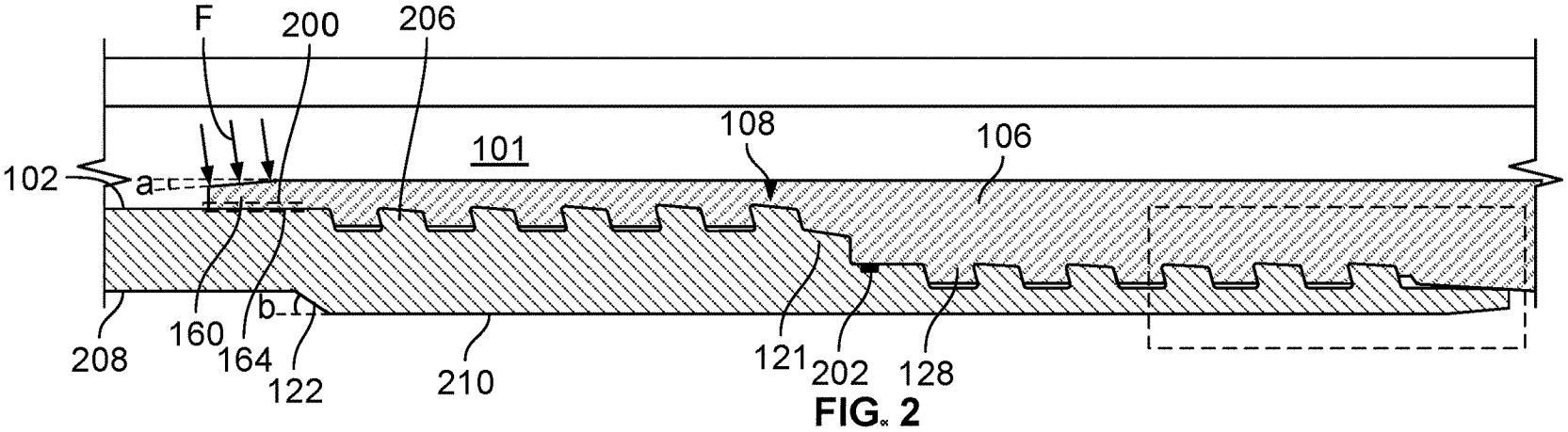
FIG. 2 is a detailed view of a section of the pipe assembly in FIG. 1, showing a threaded connection.

Referring now to FIG. 2 the annular lip 160 is chamfered at an angle "a" of, for example, between 5° and 25° (e.g., 15°). The annular external chamfer allows the lip 160 to be energized under pressure applied by a fluid "F" at the annulus 101. For example, the shallow angle run out chamfer area features a reduced wall thickness at the annular lip 160, allowing the lip to be slightly pushed inwardly under pressure to energize the fluid seal. The seal surface 164 (and the external surface of the pipes 102, 104) have polished surfaces to provide excellent leak-tightness under pressure, temperature, and thermal cycling loading conditions.

In some implementations, the first pipe 102 and second pipe 104 have a sealing ring 202 at or near the mid shoulder 121. The sealing ring 202 forms a seal that prevents fluid from flowing across the threaded connection in case fluid leaks through the metal-to-metal seals 200. Additionally, the intermediate shoulder 121 can promote self-alignment of the connection during stabbing.

Additionally, the shoulder 121 can reduce, in combination with the double taper profile, the risk of cross threading. For example, the shoulder 121 of the first pipe 102 bears against the shoulder of the coupling 106 to increase the torsional capacity of the coupling connection with comparison to connections that do not have two contacting shoulders.

The bore of the first and second pipes 102, 104 has an internal upset 122 that increases the thickness of the pin (e.g., the threaded end) of the pipes 102, 104. The increased cross-sectional area following the upset 122 can increase the torsional capacity of the pipes 102, 104. The upset 122 includes a section that converges from a first bore section 208 of the pipe 102 to a second bore 210 of the pipe 102. The second bore section 210 spans the length of the first threaded end and has an internal diameter that is smaller than the internal diameter of the first bore section 208.

The angle "b" of the internal upset is, for example, between 1° and 60° (with respect to the central axis "A" of the pipes), and preferably between 1° and 30° (within a tolerance of −2° to +0°). For example, if the pipes 102, 104 have an outer diameter that is less than 7 inches, the angle "b" can be between 1° and 10° (e.g., 5°). If the pipes 102, 104 have an outer diameter that is greater than 7 inches (e.g., greater than 9.625 inches), the internal upset chamfer angle "b" can range between 15° to 30°. Additionally, both edges of the internal upset 122 can be rounded off with a radius of, for example, between 5 and 30 millimeters (e.g., 15-millimeter radius). The upset 122 can be disposed at, before, or after the beginning of the thread 108. For example, the upset 122 can be disposed before the threads 108 (to the left of the threads 108 in FIG. 2). In some implementations, the distance from the start of the internal upset 122 to the last engaged thread 206 of the pin connection is between 2.5 to 3 times the specified wall thickness of the pipe (depending on the size and wall thickness of the pipe). Such distance can minimize residual stress build up in the last engaged thread 206

Figure 3:
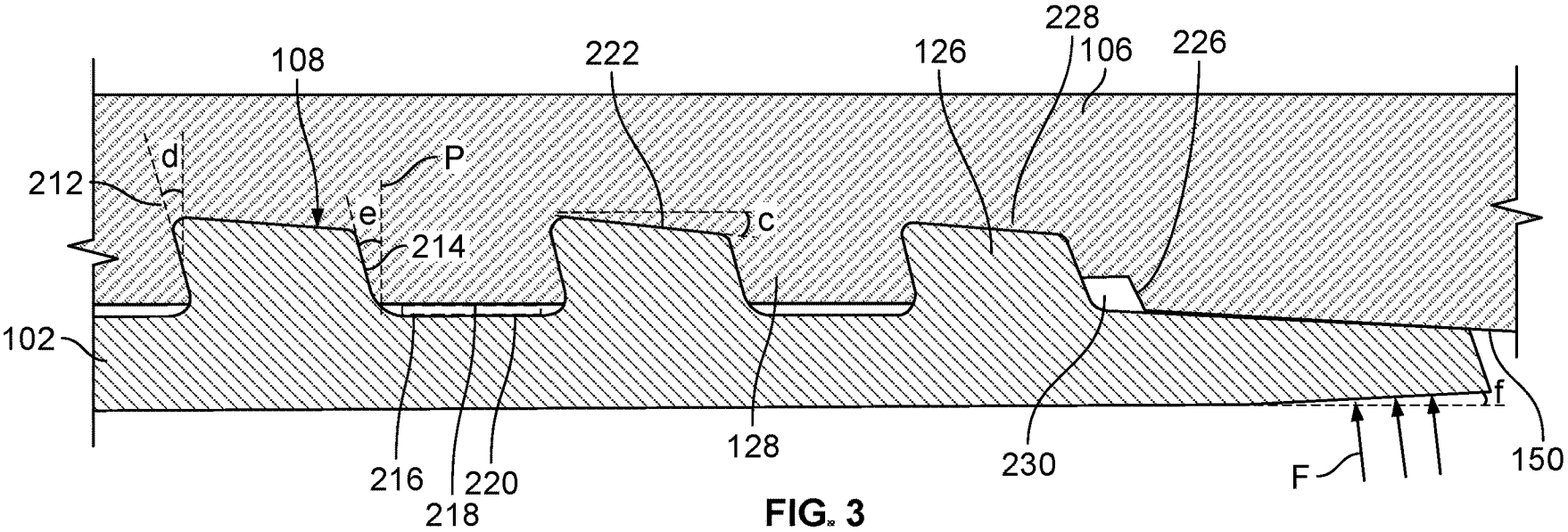
FIG. 3 is a detailed view of the threaded connection in FIG. 2.

FIG. 3 shows the "square" threads of the pipes 102, 106. The square thread 126 of the first pipe 102 has a stab flank 214 that is slanted or angled and the square thread of the coupling 106 has a load flank 212 that is slanted or angled. For example, the stab flank 214 and the load flank 212 are slanted with respect to a plane "P" that is orthogonal to the central longitudinal axis "A" of the pipe 102. The load flank 212 is slanted at a negative angle "d" of, for example, between −2° and −8° (e.g., −5°) with respect to the plane "P," and the stabbing flank 214 can be slanted at positive angle "e" of between 7° and 15° (e.g., 10°) with respect to the plane "P." The angles "d" and "e" can help reduce the sliding contact between the pin and the box, which increases the galling resistance of the threads 126, 128. Additionally, the angle "f" can be similar to the angle "a" (see FIG. 1.)

Moreover, the thread 126 of the first pipe 102 has a concave root 216 and the thread 128 of the coupling 106 has a crest 218 (e.g., a flat or straight crest) to form, with the coupling connection formed, a dope pocket 220. The dope pocket 220 is defined between the concave root 216 and the crest 218. The crest 218 can be straight or concave (or slightly convex) to form a space between the crest 218 and the root 216. The dope pocket 220 increases a galling resistance of the threads 126, 128 and of the threaded connection in comparison to a threaded connection with a flat root and crest (e.g., a threaded connection without a dope pocket between the root and crest). The dope pocket 220 makes room for a lubricant to keep the threads 126, 128 lubricated, which can increase the galling resistance of the threads 126, 128.

Additionally, the crest 222 of the first pipe 102 has a crest tapered inwardly to form an angle "c" with respect to the longitudinal axis (and in some cases with respect to the root) of the pipe 102. The angle "c" can be, for example, between 1° and 30° (e.g., 10° or 15°)

Moreover, the collar 106 (or the first pipe 102) has an annular groove 226 at the transition between the bore surface 150 and the first internal thread 228. The annular groove 226 forms a dope pocket 230 that releases stress (e.g., by allowing lubricant to reside at the dope pocket 230) during make up.

The second pipe 104 has the same characteristics as the first pipe 102 and therefore the features of the first pipe 102 and its connection with the coupling 106 as described above are the same for the second pipe 102.

Figure 4:
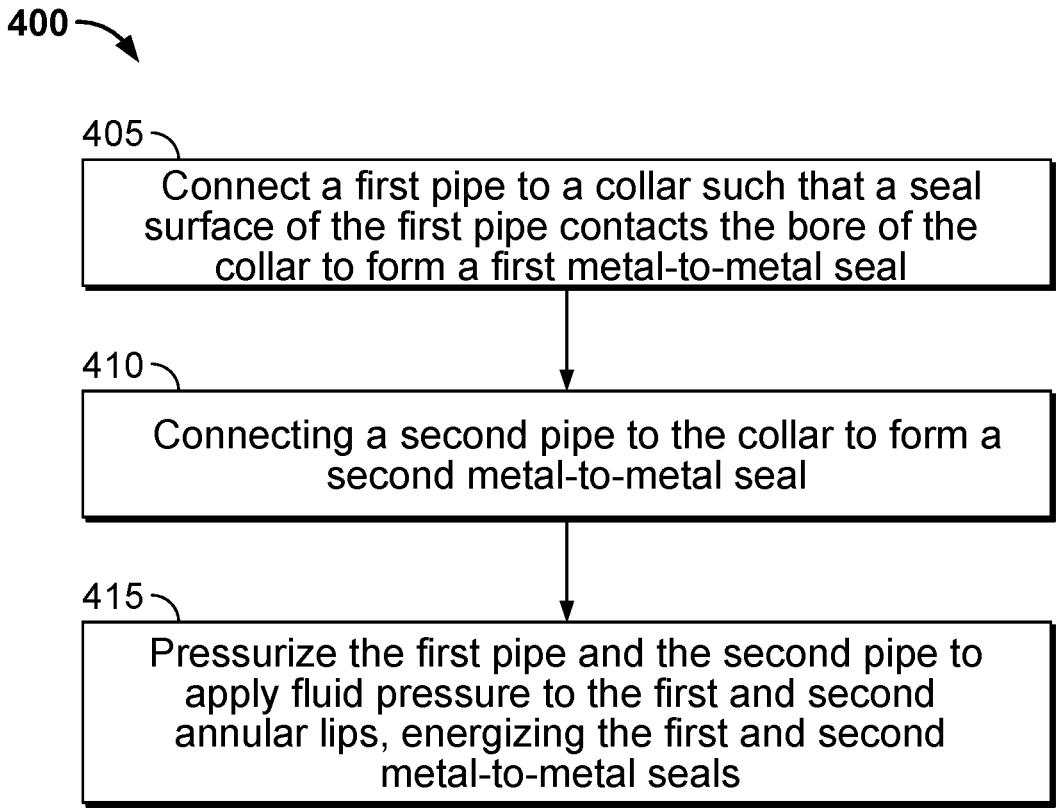
FIG. 4 is a flow chart of an example method of using a pipe assembly.

FIG. 4 is a flow chart of an example method (400) of making the threaded and coupled type connection. The method includes connecting a first pipe to a collar, the first pipe including a first external thread and a first annular lip residing at an end of the first pip. The collar has a first internal thread and a second internal thread with a bore residing between the first and second internal threads. Connecting the first pipe to the collar includes threadedly coupling the first external thread to the first internal thread of the collar such that a seal surface of the first annular lip contacts the bore of the collar to form a first metal-to-metal seal (405). The method also includes connecting a second pipe to the collar to form a similar metal-to-metal seal. (410). The method also includes pressurizing the first pipe and the second pipe to apply fluid pressure to the first and second annular lips, energizing the first and second metal-to-metal seals and increasing the contact pressure of the first and second metal-to-metal seals (415).

The pipes 102, 104 and collar 106 can be made of metal (e.g., steel) or a similar material. The pipes can be part of a production string or an injection string. In some cases, the pipes can be part of a different assembly such as a drill string or a piping system outside of a wellbore.

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

What is claimed is:

1. A pipe assembly, comprising:

a first pipe comprising a first external thread and a first annular lip residing between the first external thread and a rim of the first pipe, the first external thread comprising a load flank slanted such that an edge between the load flank and a crest of the first external thread overhangs a root of the first external thread, the first annular lip comprising a first external seal surface and a first internal annular beveled surface, the first external thread comprising a first shoulder residing along the first external thread;

a second pipe comprising a second external thread and a second annular lip residing between the second external thread and a rim of the second pipe, the second annular lip comprising a second external seal surface and a second internal annular beveled surface, the second external thread comprising a second shoulder residing along the second external thread; and a collar configured to be disposed between and threadedly coupled to the first pipe and the second pipe to form a coupling connection, the collar comprising a first internal thread configured to be threadedly coupled to the first external thread and a second internal thread configured to be threadedly coupled to the second internal thread, the collar comprising a bore residing between the first internal thread and the second internal thread and configured to contact, with the coupling connection formed, the first external seal surface and the second external seal surface to form respective metal-to-metal seals that are energized under fluid pressure at the first and second internal annular beveled surfaces to increase a contact pressure of the respective metal-to-metal seals, wherein the first and second internal threads of the collar each comprises respective internal shoulders configured to bear against the first and second shoulders of the first and second pipes.

2. The pipe assembly of claim 1, wherein the first pipe and second pipe are configured to be disposed within a wellbore and flow production fluid or injection fluid, the first pipe and the second pipe comprising an external diameter of less than 7 inches.

3. The pipe assembly of claim 1, wherein the first internal annular beveled surface faces away from the first external seal surface, the first internal annular beveled surface comprising a chamfer of between 5° and 25° and a thickness such that the annular lip bends, under fluid pressure and with the coupling connection formed, outwardly to increase the contact pressure of the respective metal-to-metal seal.

4. The pipe assembly of claim 1, wherein the crest is slanted at an angle of between 10° and 15° such that, in side view, the edge of the first external thread is higher than a second edge of the first external thread, the second edge residing between the crest and a stab flank of the first external thread.

5. A pipe assembly, comprising:

a first pipe comprising a first external thread and a first annular lip residing between the first external thread and a rim of the first pipe, the first external thread comprising a load flank slanted such that an edge between the load flank and a crest of the first external thread overhangs a root of the first external thread, the first annular lip comprising a first external seal surface and a first internal annular beveled surface;

a second pipe comprising a second external thread and a second annular lip residing between the second external thread and a rim of the second pipe, the second annular lip comprising a second external seal surface and a second internal annular beveled surface; and a collar configured to be disposed between and threadedly coupled to the first pipe and the second pipe to form a coupling connection, the collar comprising a first internal thread configured to be threadedly coupled to the first external thread and a second internal thread configured to be threadedly coupled to the second internal thread, the collar comprising a bore residing between the first internal thread and the second internal thread and configured to contact, with the coupling connection formed, the first external seal surface and the second external seal surface to form respective metal-to-metal seals that are energized under fluid pressure at the first and second internal annular beveled surfaces to increase a contact pressure of the respective metal-to-metal seals;

wherein the collar further comprises a third annular lip residing between the first internal thread and a first rim of the collar pipe, the third annular lip comprising a first internal seal surface and a first external annular beveled surface, and the collar further comprises a fourth annular lip residing between the second internal thread and a second rim of the collar pipe, the fourth annular lip comprising a second internal seal surface and a second external annular beveled surface, wherein the first and second internal seal surfaces are configured to contact, with the coupling connection formed, respective external walls of the first and second pipes to form respective metal-to-metal seals that are energized under fluid pressure at the first and second external annular beveled surfaces to prevent fluid from flowing across the coupling connection.

6. A pipe assembly, comprising:

a first pipe comprising a first external thread and a first annular lip residing between the first external thread and a rim of the first pipe, the first external thread comprising a load flank slanted such that an edge between the load flank and a crest of the first external thread overhangs a root of the first external thread, the first annular lip comprising a first external seal surface and a first internal annular beveled surface;

a second pipe comprising a second external thread and a second annular lip residing between the second external thread and a rim of the second pipe, the second annular lip comprising a second external seal surface and a second internal annular beveled surface; and a collar configured to be disposed between and threadedly coupled to the first pipe and the second pipe to form a coupling connection, the collar comprising a first internal thread configured to be threadedly coupled to the first external thread and a second internal thread configured to be threadedly coupled to the second internal thread, the collar comprising a bore residing between the first internal thread and the second internal thread and configured to contact, with the coupling connection formed, the first external seal surface and the second external seal surface to form respective metal-to-metal seals that are energized under fluid pressure at the first and second internal annular beveled surfaces to increase a contact pressure of the respective metal-to-metal seals;

wherein the first external thread comprises a first tapered thread, a second tapered thread, and a shoulder residing between the first tapered thread and the second tapered thread, the first tapered thread comprising a first square thread with the load flank slanted with respect to a plane orthogonal to a longitudinal axis of the first pipe and the second tapered thread comprising a second square thread with a second load flank slanted with respect to the plane, and wherein the first internal thread comprises two corresponding tapered threads spaced by a shoulder, the two corresponding tapered threads configured to be threadedly coupled to the first and second tapered threads.

7. The pipe assembly of claim 6, wherein the load flank is slanted at an angle of between 2° and 8° with respect to the plane, and a stab flank of the first external thread is slanted in a common direction as the load flank at an angle of between 7° and 15° with respect to the plane.

8. The pipe assembly of claim 6, wherein the shoulder of the first external thread is configured to bear, with the coupling connection formed, against the shoulder of the first internal thread, increasing a torsional capacity of the coupling connection absent a shoulder.

9. The pipe assembly of claim 6, wherein the first tapered thread is less coarse than the second tapered thread.

10. The pipe assembly of claim 6, further comprising a sealing ring disposed at one of the shoulders and configured to form, with the other one of the shoulders, a seal.

11. The pipe assembly of claim 6, wherein the first pipe comprises an internal upset comprising a section converging from a first bore of the first pipe to a second bore of the first pipe, the second bore spanning a length of the first external thread and defining an internal diameter smaller than the internal diameter of the first bore.

12. The pipe assembly of claim 11, wherein the section is slanted at an angle of between 1° and 30° with respect to a longitudinal axis of the first pipe.

13. The pipe assembly of claim 11, wherein the first thread comprises a crest tapered inwardly in a direction extending from a start of the thread to the rim and with respect to the longitudinal axis.

14. The pipe assembly of claim 11, wherein the second bore comprises a constant diameter spanning the first tapered thread and the second tapered thread, the second bore comprising a constant diameter from the internal upset to the first internal annular beveled surface.

15. The pipe assembly of claim 6, wherein the first tapered thread comprises a first constant outer diameter and the a second tapered thread comprises a second constant outer diameter less than the first constant outer diameter.

16. A pipe assembly, comprising:

a first pipe comprising a first external thread and a first annular lip residing between the first external thread and a rim of the first pipe, the first external thread comprising a load flank slanted such that an edge between the load flank and a crest of the first external thread overhangs a root of the first external thread, the first annular lip comprising a first external seal surface and a first internal annular beveled surface;

a second pipe comprising a second external thread and a second annular lip residing between the second external thread and a rim of the second pipe, the second annular lip comprising a second external seal surface and a second internal annular beveled surface; and a collar configured to be disposed between and threadedly coupled to the first pipe and the second pipe to form a coupling connection, the collar comprising a first internal thread configured to be threadedly coupled to the first external thread and a second internal thread configured to be threadedly coupled to the second internal thread, the collar comprising a bore residing between the first internal thread and the second internal thread and configured to contact, with the coupling connection formed, the first external seal surface and the second external seal surface to form respective metal-to-metal seals that are energized under fluid pressure at the first and second internal annular beveled surfaces to increase a contact pressure of the respective metal-to-metal seals;

wherein the first and second external threads comprise a concave root to form, with the coupling connection formed, a dope pocket defined between the concave root and a crest of the first and second internal threads, allowing lubricant to reside at the dope pocket.

17. A pipe assembly, comprising:

a first pipe comprising a first external thread and a first annular lip residing between the first external thread and a rim of the first pipe, the first external thread comprising a load flank slanted such that an edge between the load flank and a crest of the first external thread overhangs a root of the first external thread, the first annular lip comprising a first external seal surface and a first internal annular beveled surface;

a second pipe comprising a second external thread and a second annular lip residing between the second external thread and a rim of the second pipe, the second annular lip comprising a second external seal surface and a second internal annular beveled surface; and a collar configured to be disposed between and threadedly coupled to the first pipe and the second pipe to form a coupling connection, the collar comprising a first internal thread configured to be threadedly coupled to the first external thread and a second internal thread configured to be threadedly coupled to the second internal thread, the collar comprising a bore residing between the first internal thread and the second internal thread and configured to contact, with the coupling connection formed, the first external seal surface and the second external seal surface to form respective metal-to-metal seals that are energized under fluid pressure at the first and second internal annular beveled surfaces to increase a contact pressure of the respective metal-to-metal seals;

wherein the collar comprises an annular groove between a transition between the bore and the first internal thread, the annular groove forming a dope pocket configured to retain lubricant to release stress from the first internal thread during make up.

18. A method, comprising:

connecting a first pipe to a collar, the first pipe comprising a first external thread and a first annular lip residing at an end of the first pipe, the first external thread comprising a load flank slanted such that, in side view, an edge between the load flank and a crest of the first external thread overhangs a root of the first external thread, the collar comprising a first internal thread and a second internal thread with a bore residing between the first and second internal threads, wherein connecting the first pipe to the collar comprises threadedly coupling the first external thread to the first internal thread of the collar such that a seal surface of the first annular lip contacts the bore of the collar to form a first metal-to-metal seal;

connecting a second pipe to the collar, the second pipe comprising a second external thread and a second annular lip residing at an end of the second pipe, wherein connecting the second pipe to the collar comprises threadedly coupling the second external thread to the second internal thread of the collar such that a seal surface of the second annular lip contacts the bore of the collar to form a second metal-to-metal seal; and pressurizing the first pipe and the second pipe to apply fluid pressure to the first and second annular lips, energizing the first and second metal-to-metal seals and increasing a contact pressure of the first and second metal-to-metal seals.

19. The method of claim 18, wherein the first pipe comprises an intermediate shoulder and connecting the first pipe to the collar comprises threadedly connecting the first pipe until the shoulder bears against an intermediate shoulder of the collar.

20. A pipe assembly, comprising:

a first pipe comprising a first external thread and a first annular lip residing between the first external thread and a rim of the first pipe, the first annular lip comprising a first external seal surface and a first internal annular beveled surface;

a second pipe comprising a second external thread and a second annular lip residing between the second external thread and a rim of the second pipe, the second annular lip comprising a second external seal surface and a second internal annular beveled surface; and a collar configured to be disposed between and threadedly coupled to the first pipe and the second pipe to form a coupling connection, the collar comprising a first internal thread configured to be threadedly coupled to the first external thread and a second internal thread configured to be threadedly coupled to the second internal thread, the collar comprising a bore residing between the first internal thread and the second internal thread and configured to contact, with the coupling connection formed, the first external seal surface and the second external seal surface to form a metal-to-metal seal that is energized under fluid pressure at the first and second internal annular beveled surfaces;

wherein the first external thread comprises a first tapered thread, a second tapered thread, a shoulder residing between the first tapered thread and the second tapered thread, and a sealing ring, the first tapered thread comprising a first square thread with a first flank slanted with respect to a plane orthogonal to a longitudinal axis of the first pipe and the second tapered thread comprising a second square thread with a second flank slanted with respect to the plane, and wherein the first internal thread comprises two corresponding tapered threads spaced by a shoulder, the two corresponding tapered threads configured to be threadedly coupled to the first and second tapered threads, the sealing ring disposed at one of the shoulders and configured to form, with the other one of the shoulders, a seal.

* * * * *